US007650894B2

(12) United States Patent
Werner

(10) Patent No.: US 7,650,894 B2
(45) Date of Patent: Jan. 26, 2010

(54) EYELINER PENCIL

(76) Inventor: Melanie R. Werner, 6 Thorn St., Sewickley, PA (US) 15143

( * ) Notice: Subject to any disclaimer, the term of this patent is extended or adjusted under 35 U.S.C. 154(b) by 107 days.

(21) Appl. No.: 10/373,986

(22) Filed: Feb. 25, 2003

(65) Prior Publication Data

US 2004/0165933 A1 Aug. 26, 2004

(51) Int. Cl.
*A45D 40/24* (2006.01)

(52) U.S. Cl. ..... 132/318

(58) Field of Classification Search ..... 132/318, 132/320, 317, 218, 216; 401/81, 123, 129, 401/126, 95, 49, 50, 88, DIG. 3, 9, 11; D19/41
See application file for complete search history.

(56) References Cited

U.S. PATENT DOCUMENTS 2,299,627 A * 10/1942 Hunter et al. ..... 132/74.5
2,442,503 A * 6/1948 Melnikoff ..... 132/320
2,901,100 A * 8/1959 Mueller et al. ..... 401/11
3,177,879 A * 4/1965 Smith ..... 132/320
3,343,552 A * 9/1967 Steffen ..... 132/320
3,352,621 A * 11/1967 Fehling et al. ..... 401/109
4,222,677 A * 9/1980 Cervantes ..... 401/129
4,428,388 A * 1/1984 Cassai et al. ..... 132/218
4,665,912 A * 5/1987 Burton ..... 606/185
4,669,492 A * 6/1987 von Kleinsorgen ..... 132/218
5,012,663 A * 5/1991 Brown ..... 72/369
5,172,994 A * 12/1992 Brown ..... 401/209
6,220,254 B1 * 4/2001 Gueret ..... 132/313
6,308,371 B1 * 10/2001 Forsline ..... 15/245.1

OTHER PUBLICATIONS

WO 96/35351 Richard Patier, Cosmetic Pencil, Nov. 14, 1996.*

* cited by examiner

*Primary Examiner*—Robyn Doan
(74) *Attorney, Agent, or Firm*—Ansel M. Schwartz

(57) ABSTRACT

An eyeliner pencil. The pencil includes an elongate portion which is gripped by the user, the elongate portion having a central axis. The pencil includes a marking portion extending from the elongate portion and in an angular relationship between 5° and 175° with the elongate portion. The marking portion is for marking an eyelid. A lipliner pencil. A method for applying eyeliner to an eyelid. A method for applying lipliner to a lip.

7 Claims, 1 Drawing Sheet

EYELINER PENCIL

FIELD OF THE INVENTION

The present invention relates to an eyeliner pencil. More specifically, the present invention relates to an eyeliner pencil having a curved tip, or a straight angled tip.

BACKGROUND OF THE INVENTION

Currently, all eyeliners operate in the same manner; that being "color inside wood or plastic wand, straight, pencil-like case. These products are deficient in that they only allow the user to apply the eyeliner at an 180° angle. This can be awkward, imprecise and in some cases, unsafe (greater risk of poking eye).

The present invention allows the user to apply the liner at approximately a 90° angle; offering much greater control, precision, improved arm/wrist/hand angle and safety, (less risk of poking eye).

SUMMARY OF THE INVENTION

The present invention pertains to an eyeliner pencil. The pencil comprises an elongate portion which is gripped by the user, the elongate portion having a central axis. The pencil comprises a marking portion extending from the elongate portion and in an angular relationship between 5° and 175° with the elongate portion. The marking portion is for marking an eyelid and/or lower lash line.

The present invention pertains to a lipliner pencil having the same features as described for the eyeliner pencil.

The present invention pertains to a method for applying eyeliner to an eyelid and/or lower lash line. The method comprises the steps of gripping an elongate portion of an eyeliner pencil. The elongate portion has a central axis. There is the step of marking the eyelid with a marking portion of the eyeliner pencil which is in an angular relationship of between 5° and 175°, and preferably between 30° and 60°, and more preferably about 45°, with the central axis of the elongate portion.

The present invention pertains to a method for applying lipliner to a lip using the same steps as described above for the eyelid, except it is applied to the lip.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
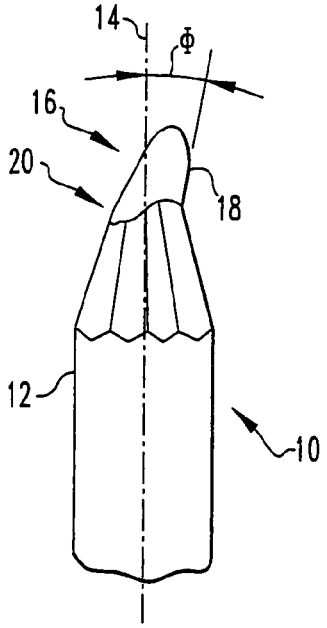
FIG. 1 is a schematic representation of an eyeliner pencil with a curved tip.
Figure 2:
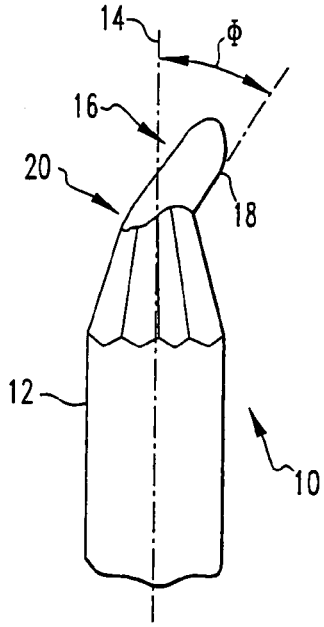
FIG. 2 is a schematic representation of an eyeliner pencil with a straight angled tip.

Referring now to the drawings wherein like reference numerals refer to similar or identical parts throughout the several views, and more specifically to FIG. 1 thereof, there is shown an eyeliner pencil 10. (Alternatively, it is a lipliner pencil 10.) The pencil 10 comprises an elongate portion 12 which is gripped by the user, the elongate portion 12 having a central axis 14. The pencil 10 comprises a marking portion 16 extending from the elongate portion 12 and in an angular relationship between 5° and 175°, and preferably between 30° and 60°, and more preferably about 45°, with the elongate portion 12. The marking portion 16 is for marking an eyelid and/or lower lash line, or lip if it is a lipliner pencil. Preferably, the marking portion 16 is curved. Alternatively, the marking portion 16 is straight.

The present invention pertains to a method for applying eyeliner to an eyelid and/or lower lash line. The method comprises the steps of gripping an elongate portion 12 of an eyeliner pencil 10. The elongate portion 12 has a central axis 14. There is the step of marking the eyelid with a marking portion 16 of the eyeliner pencil 10 which is in an angular relationship of between 5° and 175°, and preferably about 45°, with the central axis 14 of the elongate portion 12. Preferably, the marking portion 16 is curved. Alternatively, the marking portion 16 is straight. The same steps can be used to apply lipliner to a lip, instead of the eyeliner to the eyelid.

In the operation of the invention, generally, the eyeliner pencil 10 is applied using traditional methods of eyeliner application as demonstrated by makeup professionals with one exception; the tip 18 of the eyeliner pencil 10 and the hand is positioned at about a 90° angle (versus 180°), allowing greater precision and control of the eyeliner pencil 10. This angle also eliminates awkward wrist actions while simultaneously offering greater safety (less risk of poking eye). The same holds true when the eyeliner pencil 10 is instead a lipliner pencil 10, and lipliner is applied to the lip.

Most importantly, the angle of the eyeliner tip 18 (point) facilitates application of eyeliner color, allowing the wearer to place color more smoothly and precisely on the upper lid and the lower lash line; or the lip with the lipliner tip 18.

Description of How to Make the Tip 18:

Fabricate the pencil 10 and insert "color" as usual.

Step 1. Holding the eyeliner pencil 10 tip 18 in the DOWNWARD position, pour boiling water to ONE side of the pencil 10 for 15-30 seconds. This process of adding heat gently slowly draws eyeliner color out of the tube 20.

The heating process also creates the wooden (pencil-like) case to form the appropriate angle/edge at the point where the color exits the pencil 10.

Step 2: Immediately after applying (liquid) heat, turn the eyeliner tip 18 UPWARDS. Using fingers and hand, apply gentle pressure to the OPPOSITE, unheated side of the wand carefully forming and bending tip 18 to desired angle.

Step 3: Allow eyeliner pencil 10 to cool at room temperature.

It should be noted that a cap can be used to be placed over the tip, to protect the tip from damage when the pencil is not in use, as is normally done with traditional eyeliner pencils. The above description is also applicable to a lipliner pencil 10.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An eyeliner pencil comprising:

an elongate portion having a top end, which is gripped by the user, the elongate portion having a central axis; and a marking portion extending from the elongate portion at the top end of the elongate portion at a fixed angular relationship between 5° and 175° with the central axis, the marking portion for marking an eyelid a color, the marking portion made of the color and a material that is to mark the eyelid, the elongate portion positioned about the marking portion until a point where the marking portion extends from the elongate portion, the marking portion includes a solid color tube.

2. A pencil as described in claim 1 wherein the marking portion is curved where the marking portion extends from the elongate portion.

3. A pencil as described in claim 1 wherein the marking portion is straight where the marking portion extends from the elongate portion.

4. A method for applying eyeliner to an eye lid comprising the steps of:

gripping an elongate portion of an eye liner pencil, the elongate portion having a central axis; and marking the eyelid a color with a marking portion of the eye liner pencil that extends from the elongate portion at the top end of the elongate portion at a fixed angular relationship of between 5° and 175° with the central axis of the elongate portion, the marking portion made of the color and a material that is to mark the eyelid, the elongate portion positioned about the marking portion until a point where the marking portion extends from the elongate portion, the marking portion includes a solid color tube that flares to a tip which is at the fixed angular relationship.

5. A method as described in claim 4 wherein the marking portion is curved where the marking portion extends from the elongate portion.

6. A method as described in claim 4 wherein the marking portion is straight where the marking portion extends from the elongate portion.

7. A method for applying lipliner to a lip comprising the steps of:

gripping an elongate portion of a lipliner pencil, the elongate portion having a central axis; and marking the lip a color with a marking portion of the lipliner pencil that extends from the elongate portion at the top end of the elongate portion at a fixed angular relationship of between 5° and 175° with the central axis of the elongate portion, the marking portion made of the color and a material that is to mark the lip, the elongate portion positioned about the marking portion until a point where the marking portion extends from the elongate portion, the marking portion includes a solid color tube.

* * * * *